US008347519B2

(12) United States Patent
Chen

(10) Patent No.: US 8,347,519 B2
(45) Date of Patent: Jan. 8, 2013

(54) DRAINER BASKET ASSEMBLING STRUCTURE OF STEPPING WRINGER BUCKET

(75) Inventor: Yung-Hua Chen, Taipei County (TW)

(73) Assignee: Tuo Shen International Corporation, Taoyuan County (TW)

( * ) Notice: Subject to any disclaimer, the term of this patent is extended or adjusted under 35 U.S.C. 154(b) by 291 days.

(21) Appl. No.: 12/648,544

(22) Filed: Dec. 29, 2009

(65) Prior Publication Data

US 2011/0154607 A1 Jun. 30, 2011

(51) Int. Cl.
*F26B 19/00* (2006.01)

(52) U.S. Cl. ..... 34/60; 34/90; 401/122; 15/262; 134/34

(58) Field of Classification Search ..... 34/58, 59, 34/60, 80, 90, 138, 210, 242; 401/122, 123; 15/260, 262; 134/34
See application file for complete search history.

(56) References Cited

U.S. PATENT DOCUMENTS

| | | | | |
|---|---|---|---|---|
| 1,832,560 | A * | 11/1931 | Kendig | 8/137 |
| 1,882,918 | A * | 10/1932 | Robb | 15/263 |
| 2,079,186 | A * | 5/1937 | Schulman | 15/263 |
| 3,037,234 | A * | 6/1962 | Mann | 15/263 |
| 3,699,606 | A * | 10/1972 | Ribas | 15/261 |
| 6,327,740 | B1 * | 12/2001 | Baltazar | 15/261 |
| 7,412,746 | B1 * | 8/2008 | Morad | 15/262 |
| 8,079,768 | B1 * | 12/2011 | McLaughlin | 401/122 |
| 2006/0041448 | A1 * | 2/2006 | Patterson et al. | 705/1 |
| 2007/0039117 | A1 * | 2/2007 | Palmer | 15/260 |
| 2007/0113418 | A1 * | 5/2007 | Palmer | 34/58 |
| 2011/0017242 | A1 * | 1/2011 | Fiorino et al. | 134/34 |
| 2011/0154607 | A1 * | 6/2011 | Chen | 15/260 |
| 2011/0214241 | A1 * | 9/2011 | Wang | 15/228 |

FOREIGN PATENT DOCUMENTS

| | | | |
|---|---|---|---|
| DE | 19736735 | A1 * | 2/1999 |
| EP | 1774892 | A2 * | 4/2007 |
| WO | WO 9221276 | A1 * | 12/1992 |
| WO | WO 2005077239 | A2 * | 8/2005 |
| WO | WO 2007141775 | A2 * | 12/2007 |

* cited by examiner

*Primary Examiner* — Stephen M. Gravini
(74) *Attorney, Agent, or Firm* — Rosenberg, Klein & Lee

(57) ABSTRACT

A drainer basket assembling structure of a stepping wringer bucket includes a bucket body, having a containing space concavely formed at the bottom of a front side, a shaft base formed at the top of the containing space; a base, having two support stands installed in the containing space; a driving mechanism installed between the two support stands for producing a driving force; a transmission shaft installed in the containing space and whose bottom is driven by the driving mechanism; and a drainer basket driven by the transmission shaft. An upper end of the transmission shaft is protruded out from the shaft base, and a protruding end is provided for sheathing the coupling base of the drainer basket and form a sheathing and linking structure with the protruding end of the transmission shaft, such that the drainer basket can be assembled from the top of the bucket body.

7 Claims, 9 Drawing Sheets

DRAINER BASKET ASSEMBLING STRUCTURE OF STEPPING WRINGER BUCKET

BACKGROUND OF THE INVENTION

1. Field of the Invention

The present invention relates to a drainer basket assembling structure of a stepping wringer bucket, and more particularly to a structure having a drainer basket that can be assembled from the top of the wringer bucket.

2. Description of the Related Art

Mop is a common tool for cleaning a floor, and it is necessary to clean and wash away the dirt attached onto cotton cloths of a mop head after the mop has been used, and then dry the mop for the next use. Since dirty water will be attached onto a user's hands during the process of drying the cotton cloths, it is troublesome for using such conventional mop.

Therefore, some manufacturers developed a wringer bucket for spinning of the dirty water of the mop, so that the dirty water will not be attached onto the hands of users, and such wringer bucket has been disclosed in R.O.C. Pat. No. M338634. With reference to FIGS. 1 and 2 for the structure of such wringer bucket 10A, the wringer bucket 10A comprises: a bucket body 11, having a containing space 110 concavely disposed at the bottom of a front side of the bucket body 11, and a shaft base 111 disposed at the top of the bucket body 11; a base 12, having two support stands 121, installed in the containing space 110; a driving mechanism 13, installed between the two support stands 121, for producing a rotational driving force; a drainer basket 14, having a transmission shaft 15 installed at the bottom of the drainer basket 14, and extended into the containing space 110 from top to bottom through the shaft base 111, and coupled to a transmission element 131 of the driving mechanism 13, so that a user can use the driving mechanism 13 to drive the drainer basket 14 to rotate in the bucket body 11 to remove water.

However, the whole transmission shaft 15 of the aforementioned conventional wringer bucket 10A is fixed with the drainer basket 14. After the transmission shaft 15 is entered from top to bottom in to the containing space 110 during an assembling process, the transmission shaft 15 and the driving mechanism 13 are fixed onto the base 12, and thus making the assembling and removal very inconvenient.

With reference to FIG. 3 for a cross-sectional view of another conventional stepping wringer bucket 10B, this wringer bucket 10B is substantially the same as the aforementioned wringer bucket 10A, and the difference resides on that the transmission shaft 16 is shorter, such that after the transmission shaft 16 is passed from top to bottom through the shaft base 111 and coupled to the transmission element 131, the transmission shaft 16 is fixed by a positioning element such as a screw from the bottom, such that the drainer basket 14 will not fall off during the rotation and water removal processes.

Since the transmission shaft 16 of the wringer bucket 10B is locked, therefore the transmission shaft 16 cannot be removed from the opening at the top of the bucket body 11, and thus making the assembling, removal, maintenance, repair and transportation inconvenient. Obviously, the prior art requires improvements.

SUMMARY OF THE INVENTION

A primary object of the present invention is to provide a drainer basket assembling structure of a stepping wringer bucket that can be assembled or removed from the top of a bucket body directly to achieve the effects of a convenient assembling and removal to facilitate its use, maintenance, repair and transportation as well as saving storage space.

In order to achieve the above-mentioned objects, the invention includes:

a) a bucket body, having a containing space concavely formed at a front bottom of the bucket body, and a shaft base disposed at the top of the containing space;

b) a base, having two support stands, and being disposed in the containing space;

c) a driving mechanism, installed between the two support stands, for producing a driving force;

d) a transmission shaft, installed in the containing space, and the bottom of the transmission shaft being driven by the driving mechanism; and e) a drainer basket, driven by the transmission shaft;

characterized in that an upper end of the transmission shaft is protruded out from the shaft base, and the protruding end is provided for a coupling base at the middle of the bottom of the drainer basket to form a sheathing and linking structure from top to bottom with a protruding end of the transmission shaft, such that the drainer basket can be assembled from the top of the bucket body.

DETAILED DESCRIPTION OF THE PREFERRED EMBODIMENT

Figure 1:
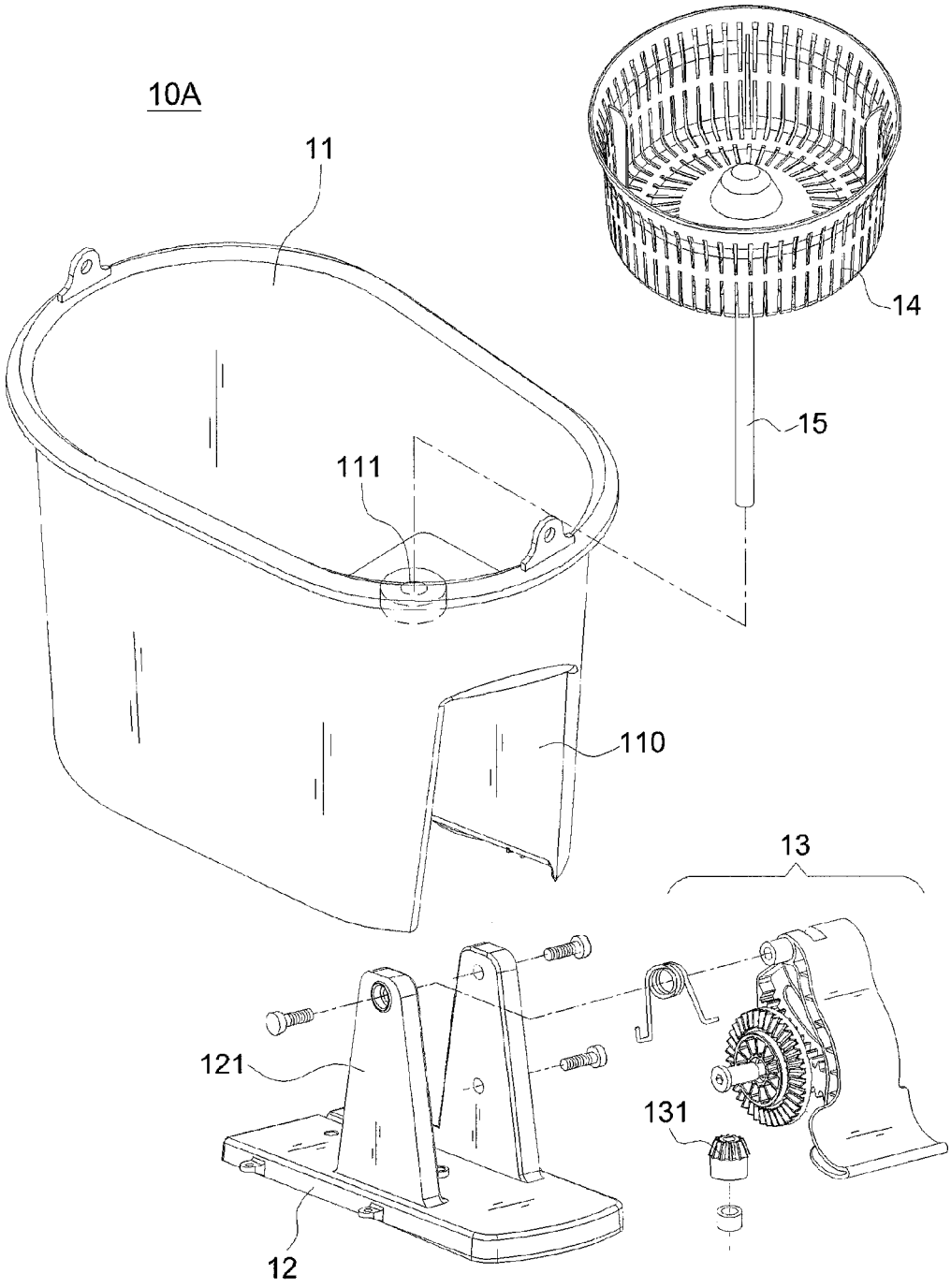
FIG.1 PRIOR ART
FIG. 1 is an exploded view of a conventional stepping wringer bucket.
Figure 2:
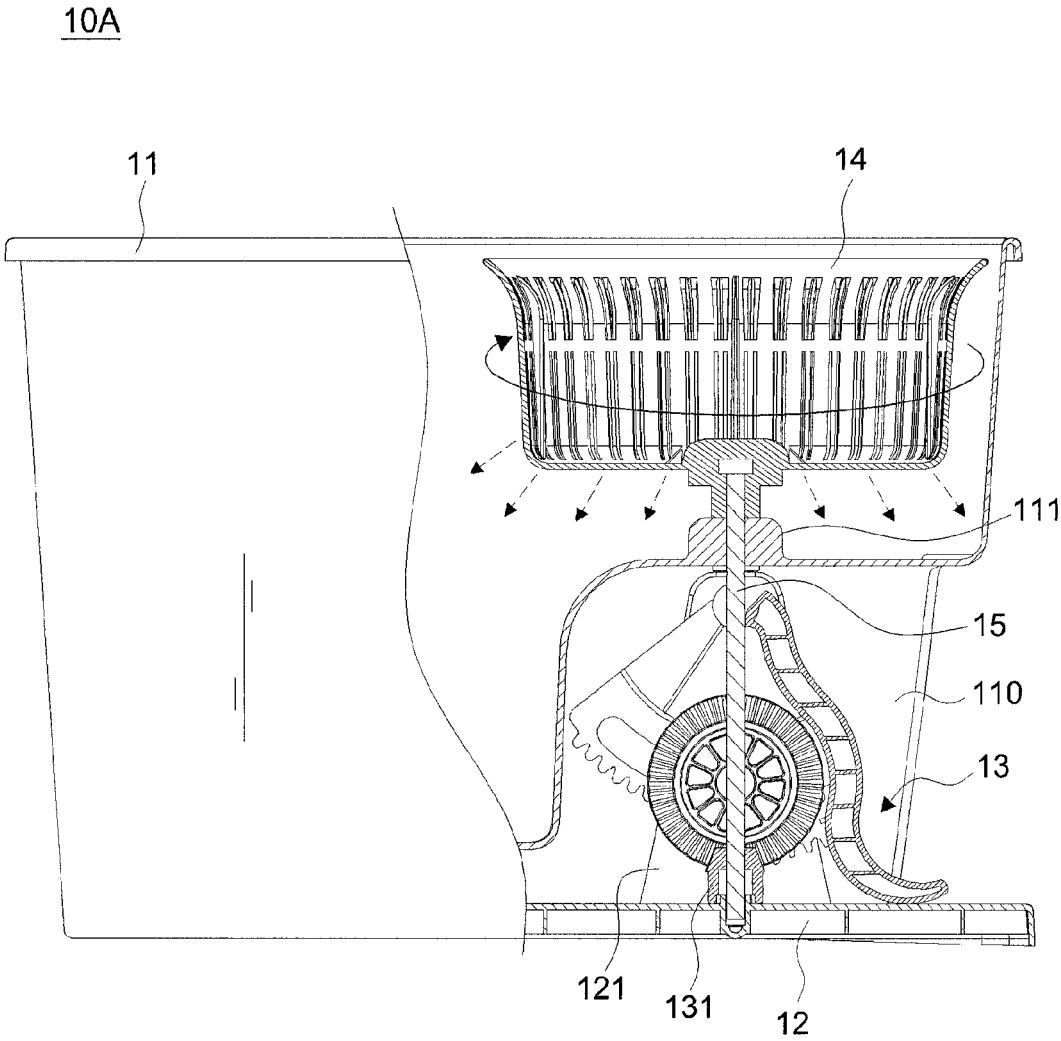
FIG.2 PRIOR ART
FIG. 2 is a cross-sectional view of a conventional stepping wringer bucket.

With reference to FIGS. 4 to 8 for a wringer bucket 20 in accordance with a preferred embodiment of the present invention, the wringer bucket 20 comprises:

a bucket body 21, having a containing space 211 concavely disposed at the bottom of a front side of the bucket body 21, and a shaft base 212 disposed at the top of the containing space;

a base 22, having two support stands 221, disposed in the containing space 211;

a driving mechanism 23, installed between the two support stands 221, for producing a driving force, wherein the driving mechanism 23 of this preferred embodiment comprises a pedal 231, a positioning bolt 232, a spring 233, a gear rack 234, a large bevel gear 235 and a small bevel gear 236;

a transmission shaft 24, installed in the containing space 211, and the bottom of the transmission shaft 24 being driven by the driving mechanism 23; and a drainer basket 25, driven by the transmission shaft 24;

characterized in that an upper end of the transmission shaft 24 is protruded out of the shaft base 212, and the protruding end 241 is provided for a coupling base 251 at the center of the bottom of the drainer basket 25 to form an engaging and linking structure from top to bottom with a protruding end 242 of the transmission shaft 24, such that the drainer basket 25 can be assembled from the top of the bucket body 21.

With the aforementioned technical measure, the present invention overcomes the problem of the conventional drainer basket that cannot be removed easily, and allows the drainer basket 25 to be installed or removed conveniently from the top of the bucket body 21. In this preferred embodiment, the structure assembled from the top includes but not limited to the protruding end 242 of the transmission shaft 24 comprised of the latching element 241 whose middle section is made of a flexible material such as rubber, a tapered cone formed at an upper section of the latching element 241, and comprised an axle hole 2411 formed at the center of the latching element 241, and matched with the external diameter of a circular groove 245 at the middle section of the transmission shaft 24, such that the transmission shaft 24 can be sheathed onto the circular groove 245 of the transmission shaft 24, and the conical base is formed and protruded from a positioning surface at the external circumference of the transmission shaft 24; and the coupling base 251 of the drainer basket 25 comprises a coupling hole 252 which is an opening disposed towards the bottom and not penetrated through the top, and a latching surface 253 disposed in the coupling hole 252 and at a position opposite to the latching element 241, such that when the drainer basket 25 is installed, the coupling base 251 is sheathed from top to bottom onto the protruding end 242 of the rotating shaft 24, and the latching element 241 is used for positioning the latching surface 253 to prevent the drainer basket 25 from falling out from the transmission shaft 24 during a rotation.

The protruding end 242 of the transmission shaft and the coupling hole 252 of the drainer basket 25 including a non-circular positioning surface constitute an engaging and linking structure. In addition, a bearing 244 is installed between the shaft base 212 and the transmission shaft 24, and the transmission shaft 24 has a flanged body 243 formed on the bearing 244.

Figure 9:
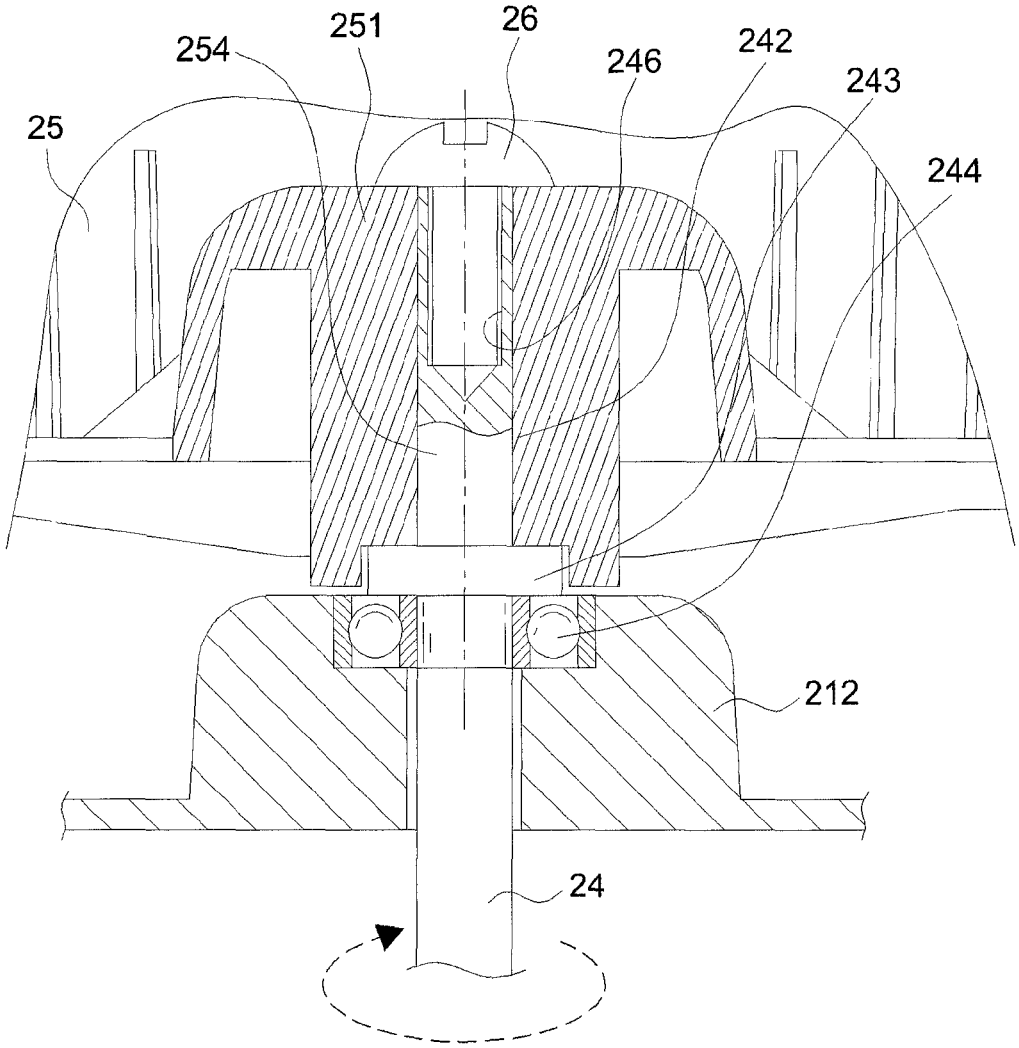
FIG. 9 is a cross-sectional view of a partial structure in accordance with another preferred embodiment of the present invention.

With reference to FIG. 9 again, the drainer basket 25 of the invention is a structure that can be assembled and removed from the top, and another preferred embodiment further comprises a screw hole 246 formed at the distal surface of the protruding end 242 of the transmission shaft 24, and the coupling base 251 of the drainer basket 25 includes a coupling hole 254 sheathed to the protruding end 242, and locked and positioned by a screw 26, and the transmission shaft 24 and the shaft base 212 of this embodiment are the same as the aforementioned preferred embodiment, and thus will not described again here.

Figure 3:
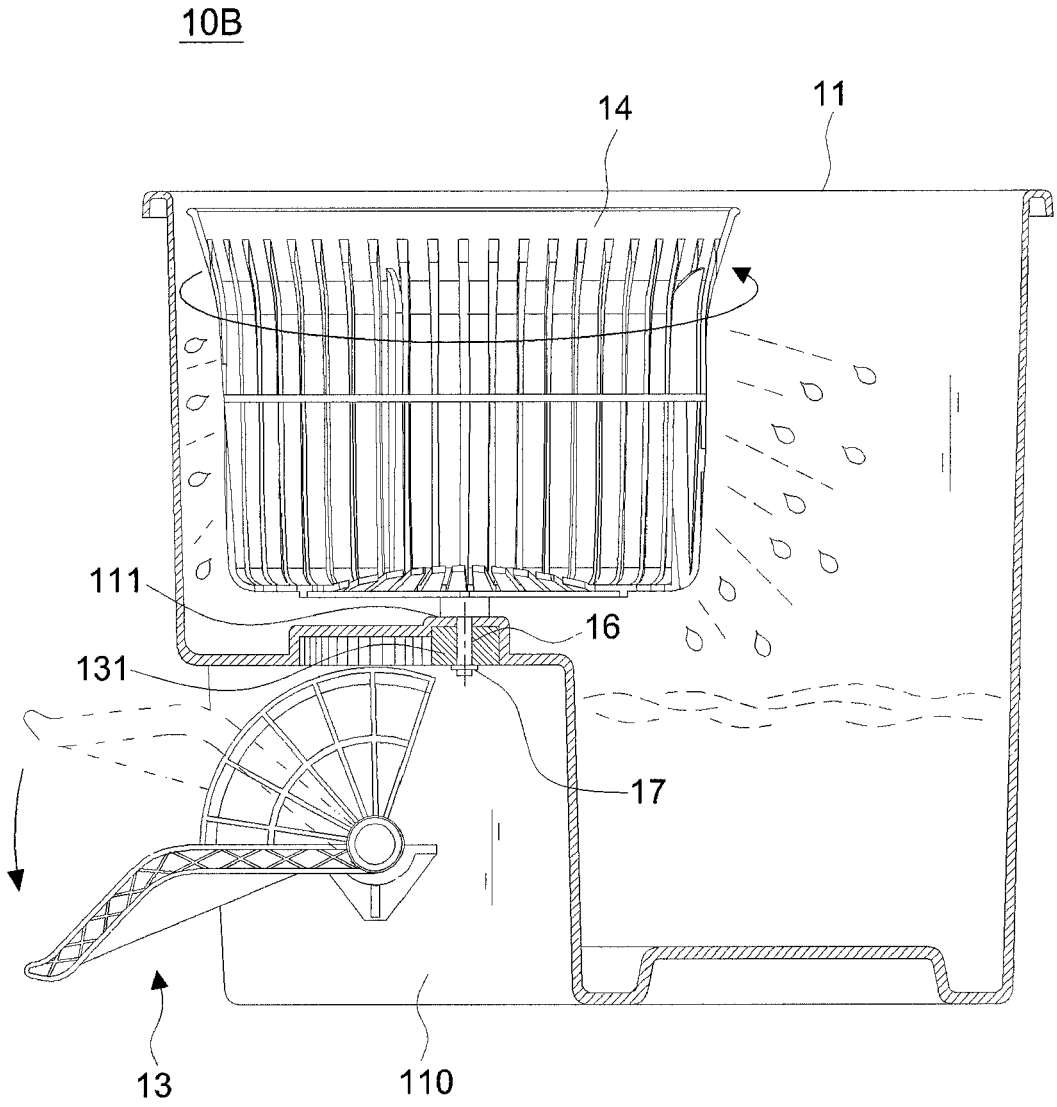
FIG.3 PRIOR ART
FIG. 3 is a cross-sectional view of another conventional stepping wringer bucket.
Figure 4:
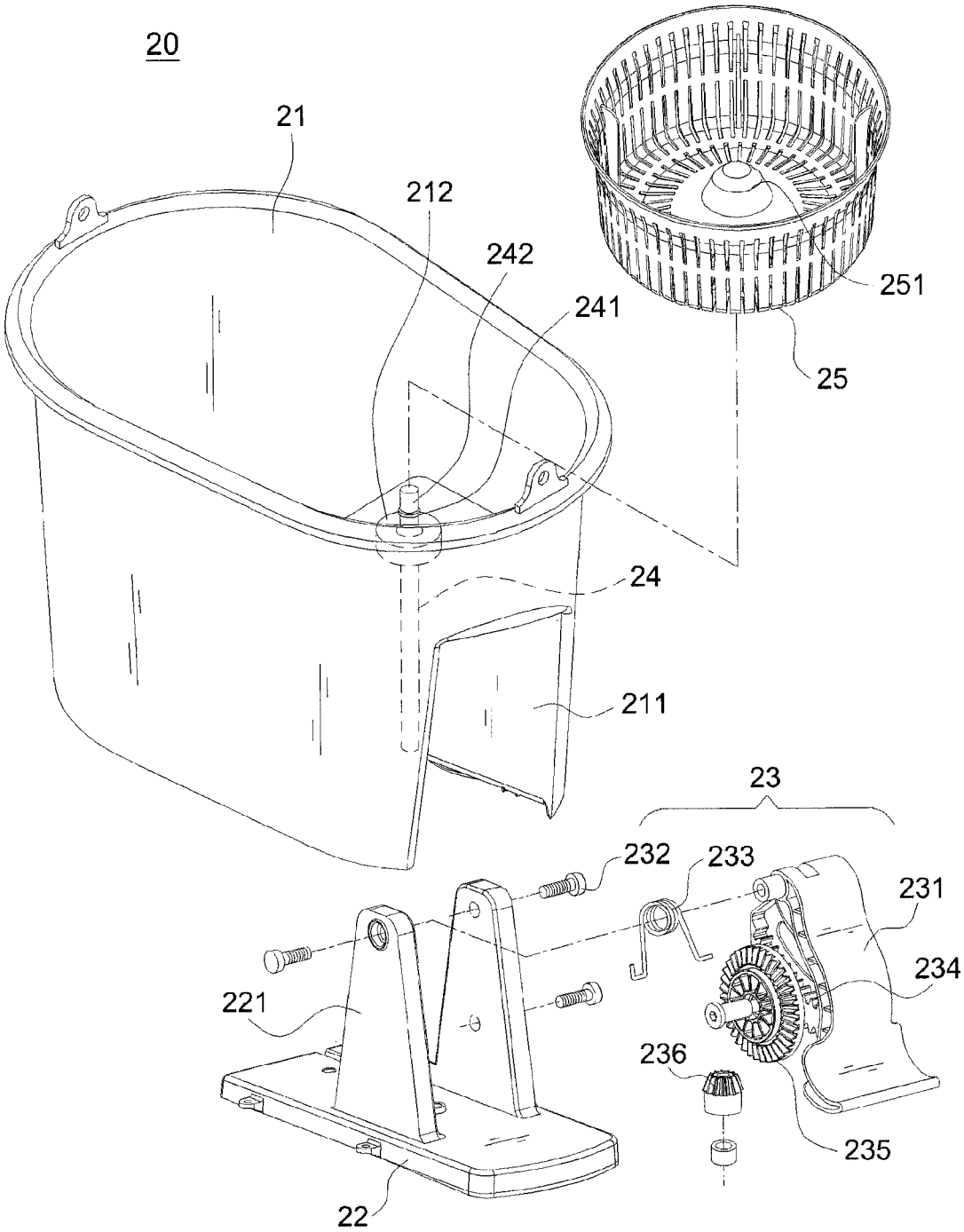
FIG. 4 is an exploded view of a preferred embodiment of the present invention.
Figure 5A:
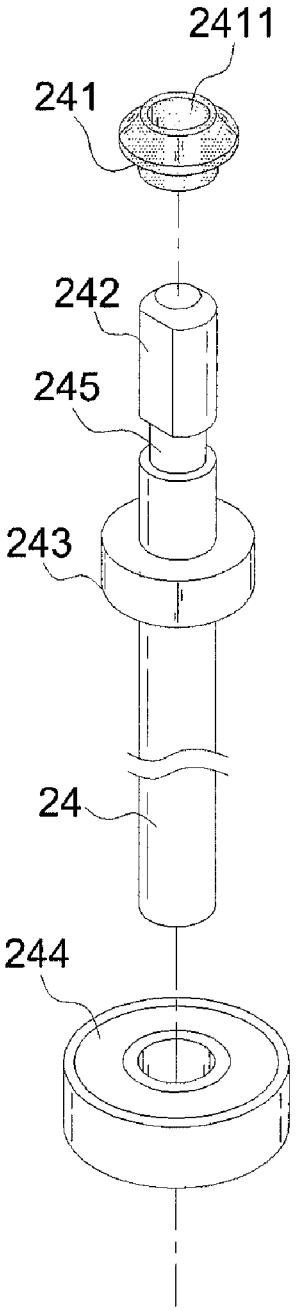
FIGS. 5A and 5B are an exploded view and a perspective view of a transmission shaft in accordance with the present invention respectively.
Figure 5B:
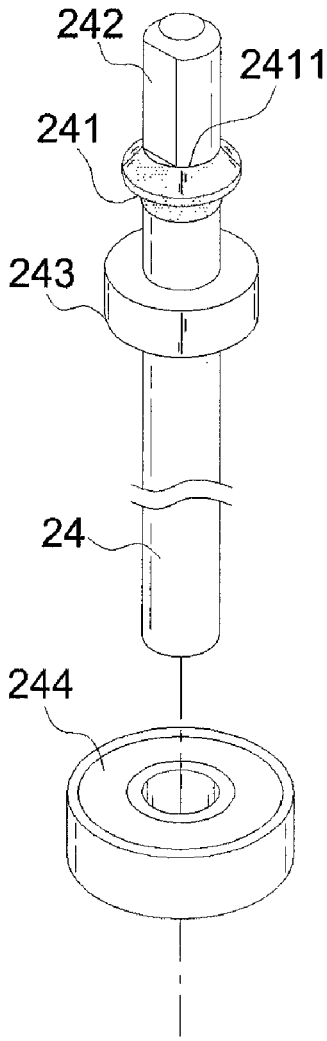
Figure 6:
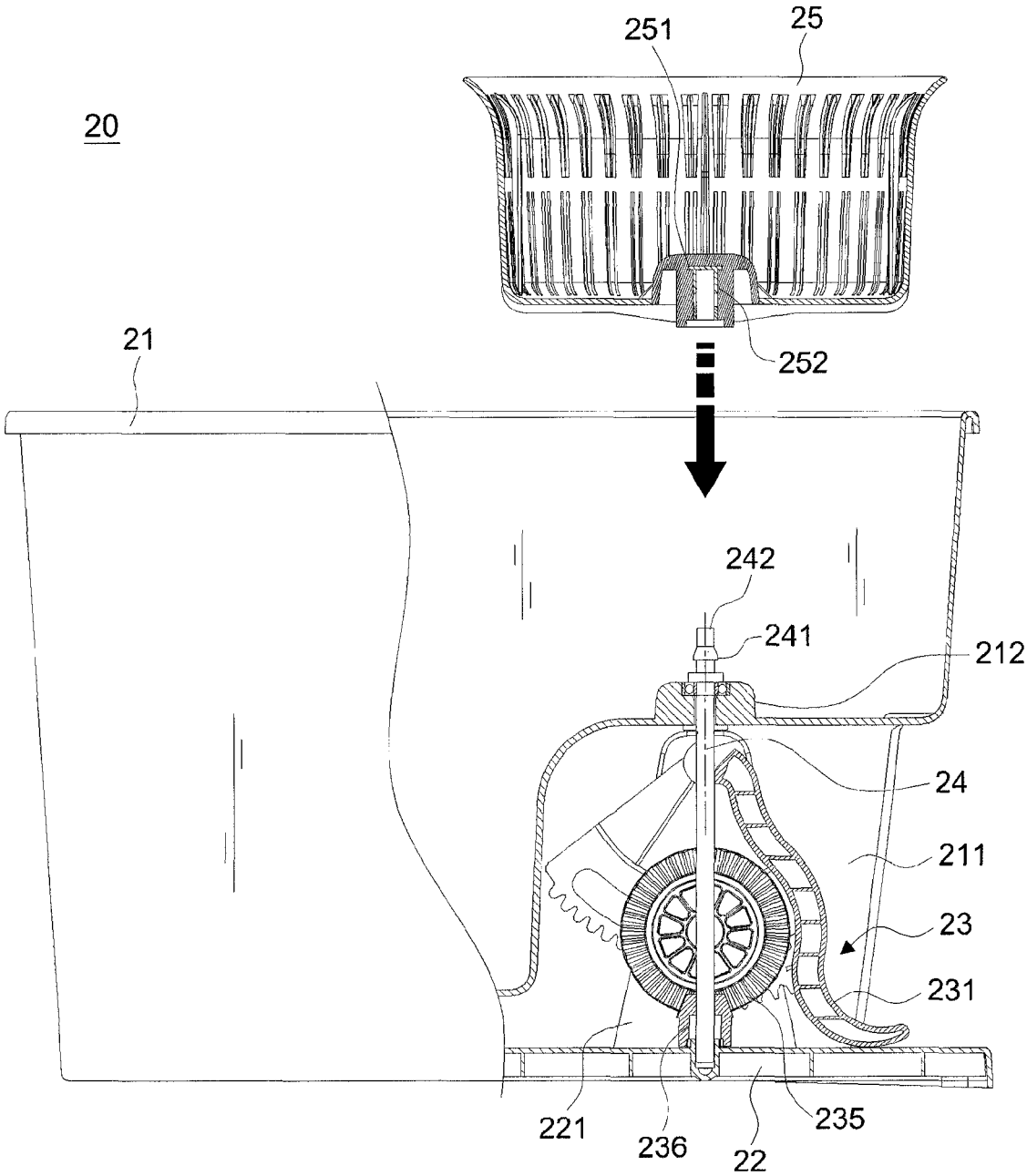
FIG. 6 is an exploded view of assembling a drainer basket from the top in accordance with the present invention.
Figure 7:
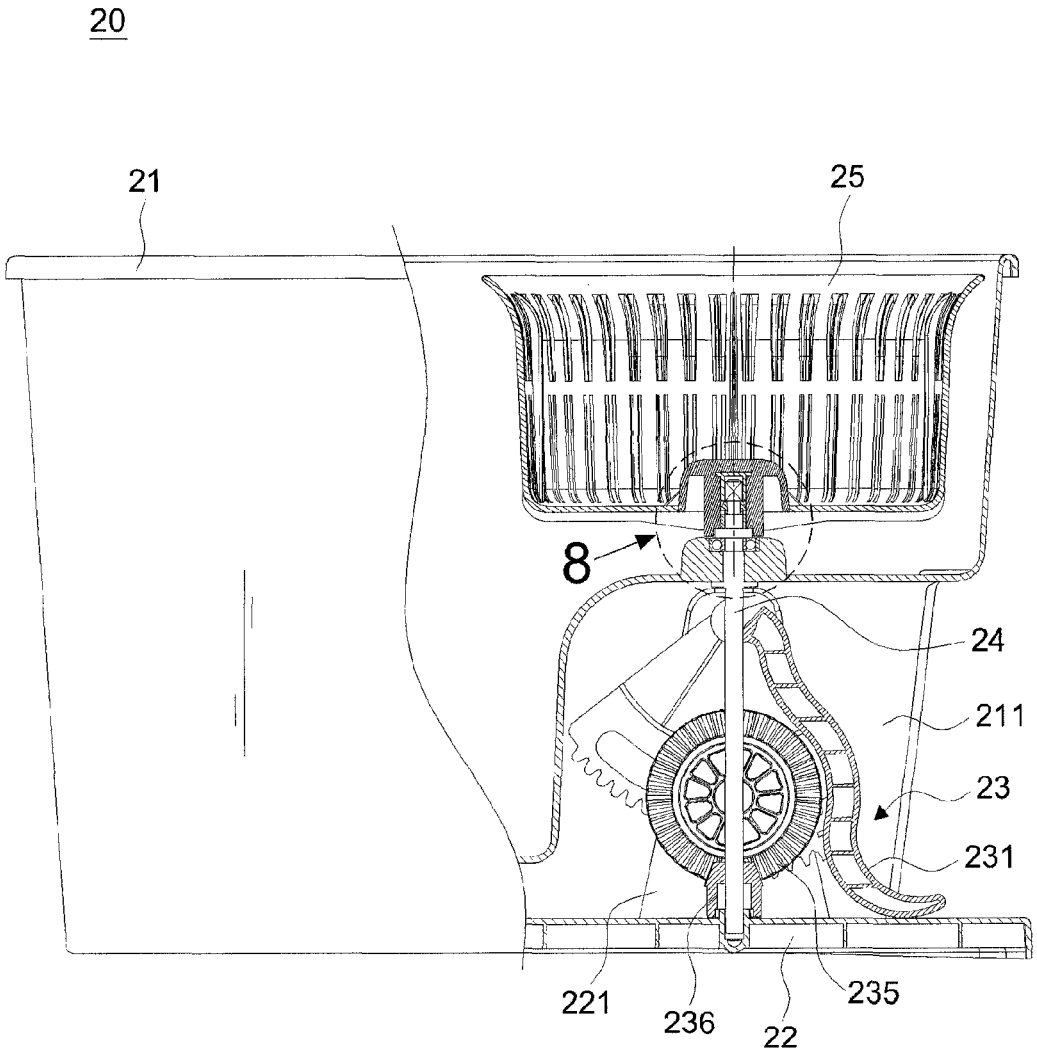
FIG. 7 is a cross-sectional view of an assembled drainer basket in accordance with the present invention.
Figure 8:
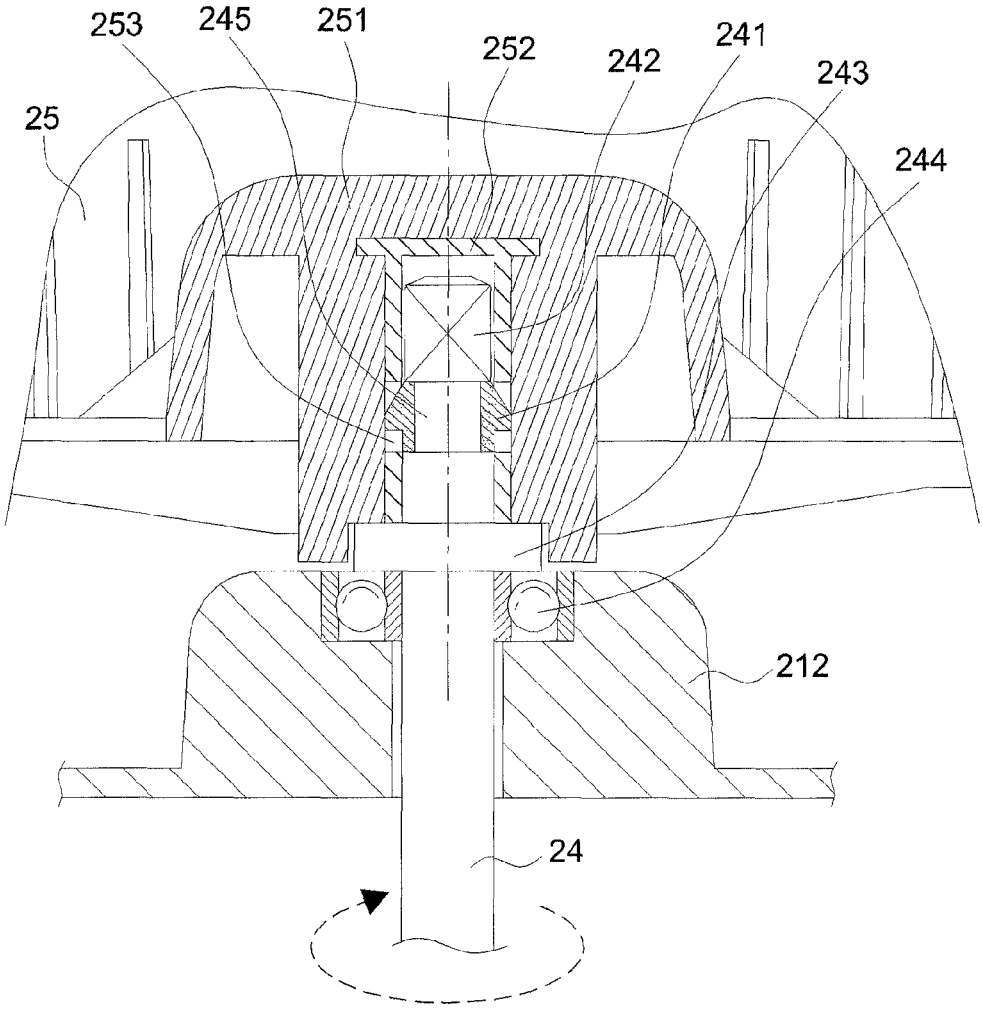
FIG. 8 is an enlarged view of a partial structure as depicted in FIG. 7.

In summation, the transmission shaft 24 of the preferred embodiment is substantially in a long shape, but not limited to such arrangement. In other words, the transmission shaft 24 is designed with a shorter length with respect to the driving mechanism 23 as shown in FIG. 3, such that the removal can be made from top to bottom.

What is claimed is:

1. A drainer basket assembling structure of a stepping wringer bucket, comprising:

a) a bucket body, having a containing space concavely formed at a front bottom of the bucket body, and a shaft base disposed at the top of the containing space;

b) a base, having two support stands, and being disposed in the containing space;

c) a driving mechanism, installed between the two support stands, for producing a driving force;

d) a transmission shaft, installed in the containing space, and the bottom of the transmission shaft being driven by the driving mechanism; and e) a drainer basket, driven by the transmission shaft;

characterized in that an upper end of the transmission shaft is protruded out from the shaft base, and the protruding end is provided for a coupling base at the middle of the bottom of the drainer basket to form a sheathing and linking structure from top to bottom with a protruding end of the transmission shaft, such that the drainer basket can be assembled from the top of the bucket body.

2. The drainer basket assembling structure of a stepping wringer bucket as recited in claim 1, wherein the protruding end of the transmission shaft includes a latching element disposed at a middle section of the transmission shaft and made of a flexible material, and a tapered cone is formed at an upper section of the latching element, and an axle hole is formed at the center and matched with an external diameter of a circular groove at the middle section of the transmission shaft for sheathing onto the circular groove of the transmission shaft, and forming the conical base on a positioning surface protruded from the external circumference of the transmission shaft; and a coupling base of the drainer basket including an opening formed downwardly from the bottom of the coupling base and non-penetrated from the top, and a latching surface formed in the coupling hole and opposite to the latching element, such that when the drainer basket is assembled, the coupling base is sheathed from top to bottom onto the protruding end of the rotating shaft, and the latching element is provided for positioning the latching surface to prevent the drainer basket from falling out when the drainer basket is rotated on the transmission shaft.

3. The drainer basket assembling structure of a stepping wringer bucket as recited in claim 2, wherein the protruding end of the transmission shaft and the coupling hole of the drainer basket include a non-circular positioning surface to constitute a sheathing and linking structure.

4. The drainer basket assembling structure of a stepping wringer bucket as recited in claim 2, further comprising a bearing installed between the shaft base and the transmission shaft, and a flanged body formed on the bearing of the transmission shaft.

5. The drainer basket assembling structure of a stepping wringer bucket as recited in claim 1, wherein the protruding end of the transmission shaft includes a screw hole formed on a distal surface of the protruding end, and the coupling base of the drainer basket includes a coupling hole sheathed to the protruding end and secured and positioned by a screw.

6. The drainer basket assembling structure of a stepping wringer bucket as recited in claim 5, wherein the top member of the transmission shaft and the coupling hole of the drainer basket including a non-circular positioning surface constitute an engaging and linking structure.

7. The drainer basket assembling structure of a stepping wringer bucket as recited in claim 5, wherein a bearing is installed between the shaft base and the transmission shaft, and the transmission shaft has a flanged body formed on the bearing.

* * * * *